US009726452B1

(12) United States Patent
Pequeno-Gimenez

(10) Patent No.: US 9,726,452 B1
(45) Date of Patent: Aug. 8, 2017

(54) MODULAR SURVIVAL TOOL

(71) Applicant: Alian Pequeno-Gimenez, Grapevine, TX (US)

(72) Inventor: Alian Pequeno-Gimenez, Grapevine, TX (US)

( * ) Notice: Subject to any disclaimer, the term of this patent is extended or adjusted under 35 U.S.C. 154(b) by 0 days.

(21) Appl. No.: 15/230,737

(22) Filed: Aug. 8, 2016

(51) Int. Cl.

| | |
|---|---|
| ***B25F 1/00*** | (2006.01) |
| ***B25F 1/02*** | (2006.01) |
| ***F41B 5/00*** | (2006.01) |
| ***B26B 23/00*** | (2006.01) |
| ***F23Q 1/02*** | (2006.01) |

(52) U.S. Cl.
CPC ..... *F41B 5/0026* (2013.01); *B25F 1/006* (2013.01); *B25F 1/02* (2013.01); *B26B 23/00* (2013.01); *F23Q 1/02* (2013.01); *F41B 5/0094* (2013.01)

(58) Field of Classification Search
CPC .... B25F 1/006; B25F 1/02; B25F 1/04; B26B 23/00; F41B 5/00; F41B 5/0026; F41B 5/1484
USPC ..... 124/23.1; 7/145, 158
See application file for complete search history.

(56) References Cited

U.S. PATENT DOCUMENTS 1,283,015 A * 10/1918 Yung ..... A45B 3/00 135/17
2,105,239 A * 1/1938 Bachtold ..... B25F 1/006 16/111.1
2,377,730 A * 6/1945 Vosbikian et al. ..... B25F 1/04 294/51
3,326,200 A * 6/1967 Grable ..... F41B 5/0026 124/23.1
3,882,560 A * 5/1975 Carrer ..... B25F 1/02 7/114
4,002,236 A * 1/1977 Tolleson ..... F41B 5/12 124/25
4,287,623 A * 9/1981 Tarran ..... B26B 23/00 7/139
4,727,609 A * 3/1988 Smith, Jr. ..... B25F 1/02 124/25
4,795,165 A * 1/1989 Tehan ..... F42B 6/04 473/578
4,907,567 A * 3/1990 Henrich ..... F41B 5/1426 124/23.1
7,219,382 B2 * 5/2007 Johnson ..... A01B 1/022 7/116
8,162,784 B1 * 4/2012 Bellefeuille ..... F41B 3/02 124/20.3

* cited by examiner

*Primary Examiner* — Alexander Niconovich
(74) *Attorney, Agent, or Firm* — Stevenson IP, LLC

(57) ABSTRACT

A modular survival tool including a tool body having a tomahawk axe selectively disposed on a top end thereof, a storage compartment therein, a pair of forward protrusions to which a pair of limb members forming a bow are selectively mounted for storage, a pair of angled rearward protrusions are disposed on a rear side of the tool body and the limb members attached thereto to form the bow, and a bow string attached to upper ends of the rearward protrusions. A modular arrow has connectable components stored within the storage compartment but assemble into an arrow for use with the bow. At least one arrow rest is disposed on one of a right side and a left side of the tool body to assist in aiming the arrow. A fire starting surface is disposed on a removable cap over the bottom end, which provides access to the storage compartment.

3 Claims, 6 Drawing Sheets

MODULAR SURVIVAL TOOL

BACKGROUND OF THE INVENTION

Various types of survival tools are known in the prior art. However, what is needed is a modular survival tool including a tool body having a removable tomahawk axe, a modular arrow selectively stored in a storage compartment within the tool body, a pair of limb members mountable to a front side of the tool body and alternately mountable to a pair of rearward protrusions on the rear side of the tool body in order to form a bow, and a bow string stretched between upper ends of the rearward protrusions. An arrow rest is disposed on at least one of the right side and the left side of the tool body to support and assist in aiming the arrow. A removable cap on a bottom end of the tool body provides access to the storage compartment while also having a fire starting surface thereon. A handle proximal the bottom end includes a cord wrapping devised to provide a gripping surface when shooting an arrow from the bow.

FIELD OF THE INVENTION

The present invention relates to tools, and more particularly, to a modular survival tool including an axe head, a bow and arrow with internal storage space and a fire starting surface on a cap at a bottom end.

SUMMARY OF THE INVENTION

The general purpose of the present modular survival tool, described subsequently in greater detail, is to provide a modular survival tool which has many novel features that result in a modular survival tool which is not anticipated, rendered obvious, suggested, or even implied by prior art, either alone or in combination thereof.

To accomplish this, the present modular survival tool includes a tool body having a front side, a rear side, a top end; a bottom end, a right side, a left side, and a hollow longitudinal shaft therein having a threaded first end at the top end and a second end. at the bottom end. The second end is selectively closable by a removable cap having a fire starting surface thereon. A storage compartment is provided within the longitudinal shaft. A tomahawk axe head is threadably engageable within the threaded first end. A rearward protrusion is disposed on the rear side proximal each of the top end and the bottom end. Each rearward protrusion is directed toward each other and is disposed at a decreasing angle of approximately 15 degrees from the respective top end and bottom end. A forward protrusion is disposed on the front side diametrically opposite each rearward protrusion. An outer side of the tool body has a convex midsection on the rear side midway between the rearward protrusions. A foramen is disposed in the midsection on each of the right side and the left side. A handle portion, disposed between the rearward protrusion on the bottom end and the midsection of the outer side, has a cord wrapping to provide a gripping surface. An aperture is centrally disposed within each of the rearward protrusions and within each of the forward protrusions.

A pair of removable limb members is selectively disposed on one of the forward protrusions on the front side and the rearward protrusions on the rear side via a socket cap ball for storage and to form a bow, respectively. A substantially conical arrow rest member is removably disposed on at least one of the right side and the left side of the tool body. The connection shaft threadingly engages one of the respective foramens. A modular arrow has a plurality of connectable components storable within the storage compartment along with a bow string. The bow string has a pair of external ends engageable to the upper ends of the limb members. A fire starting surface is disposed on an exterior side of the cap.

Thus has been broadly outlined the more important features of the present modular survival tool so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
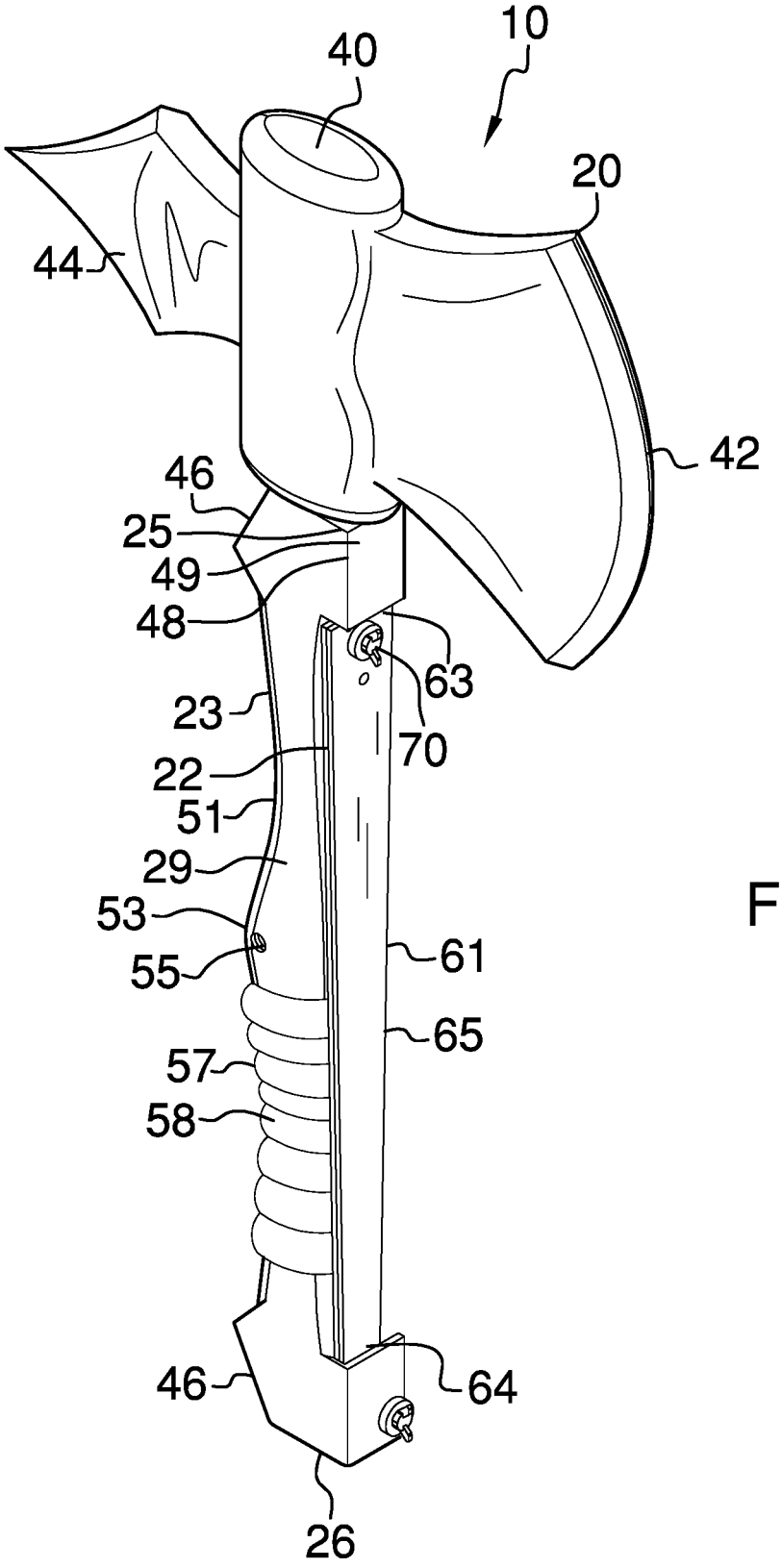
FIG. 1 is an isometric view.
Figure 2:
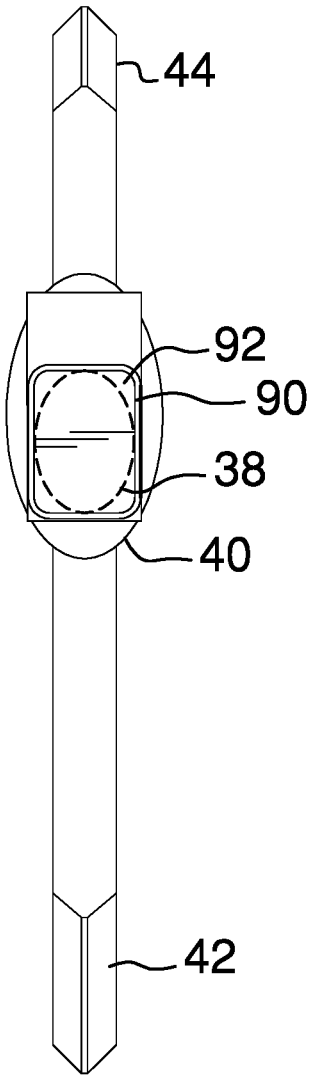
FIG. 2 is a bottom plan view.
Figure 3:
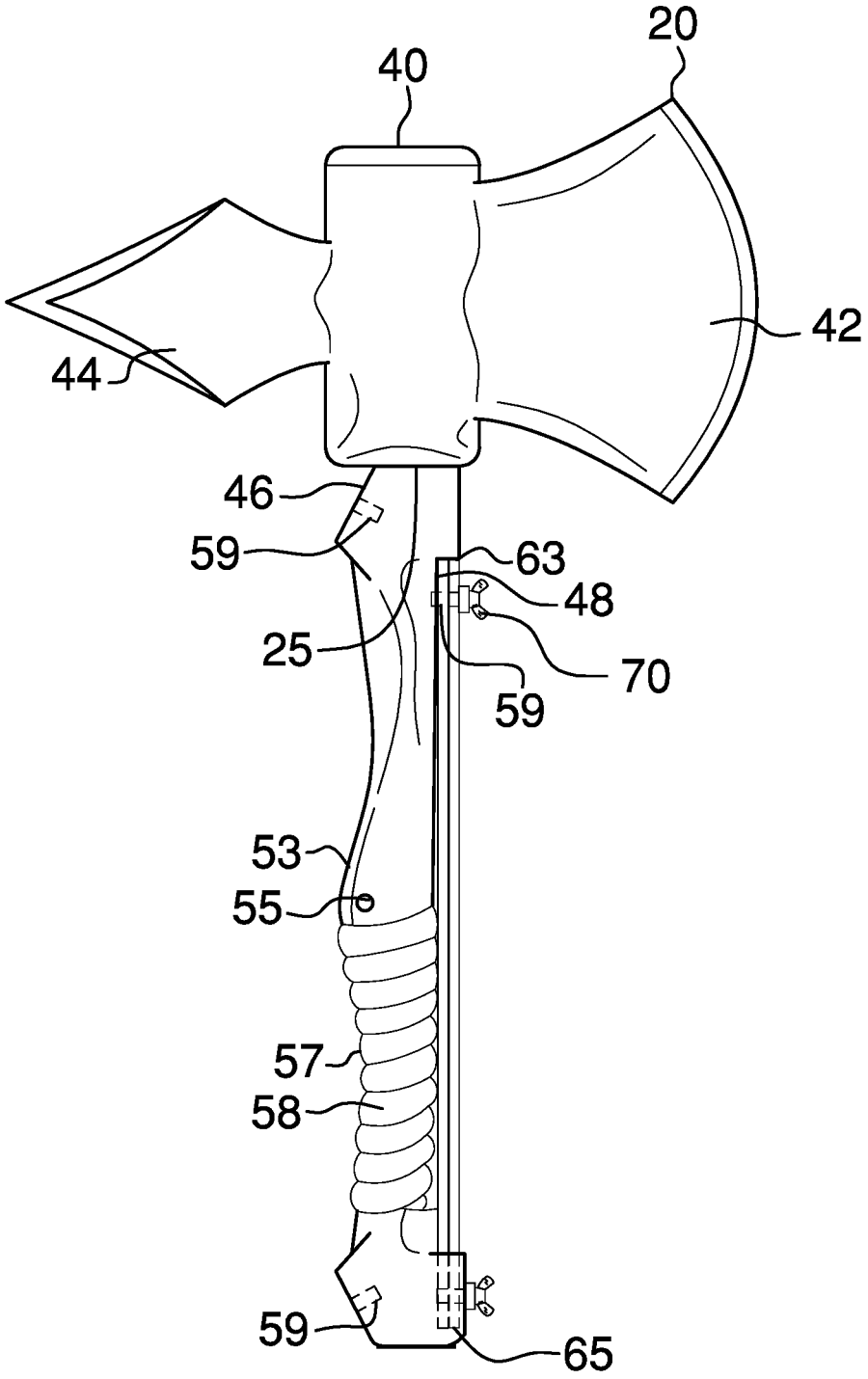
FIG. 3 is a left side elevation view.
Figure 4:
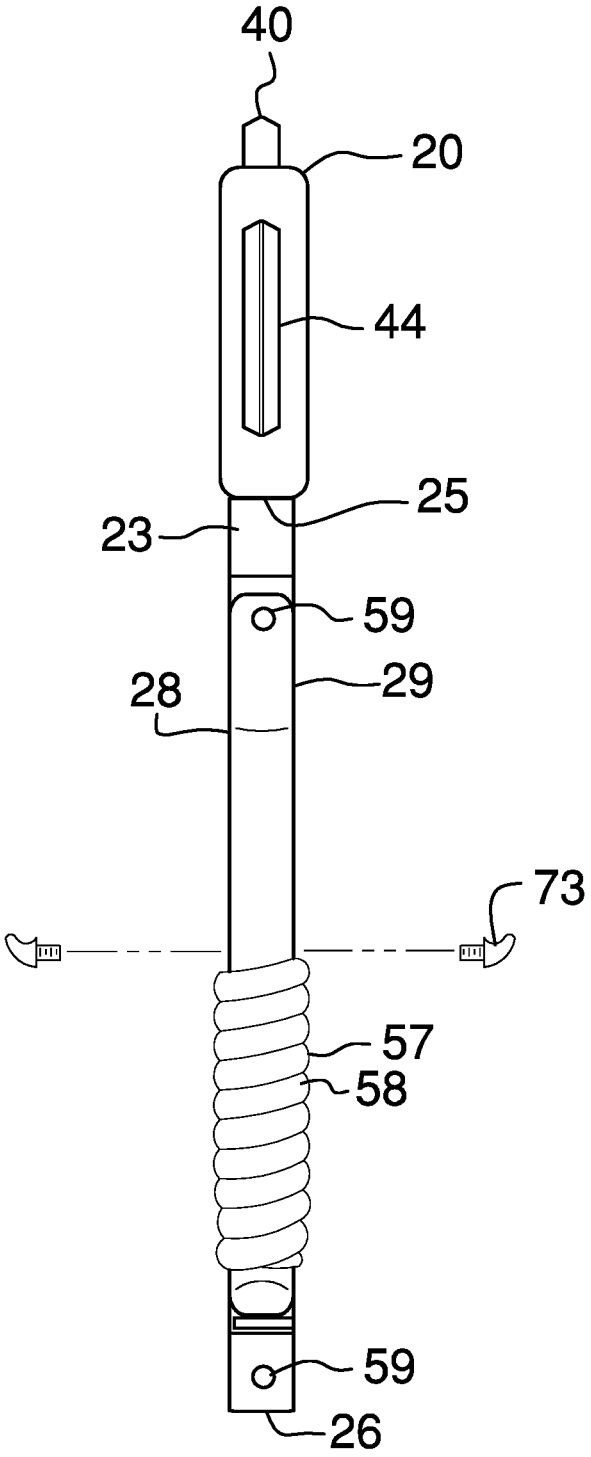
FIG. 4 is a rear elevation view.
Figure 5:
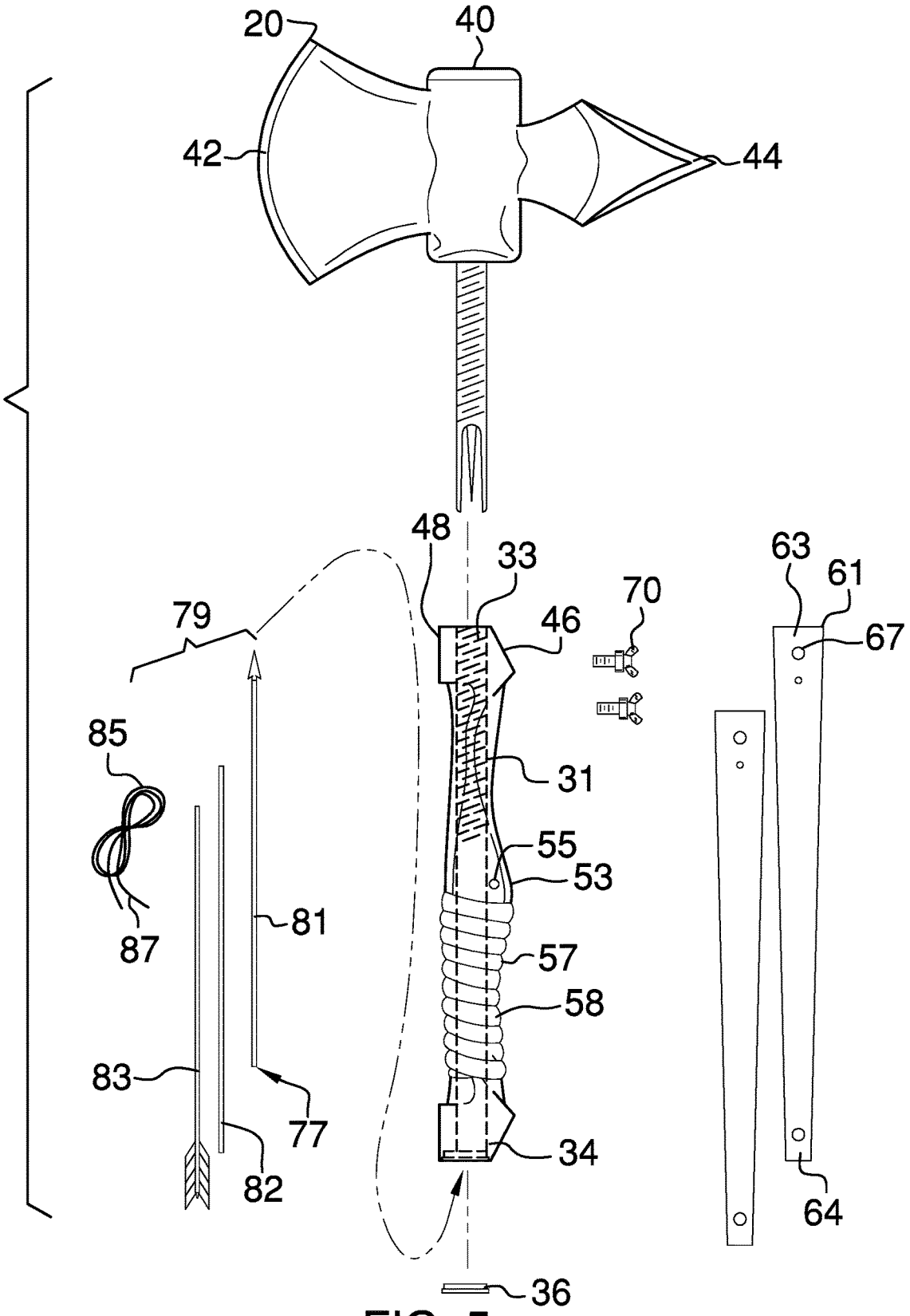
FIG. 5 is an exploded view.
Figure 6:
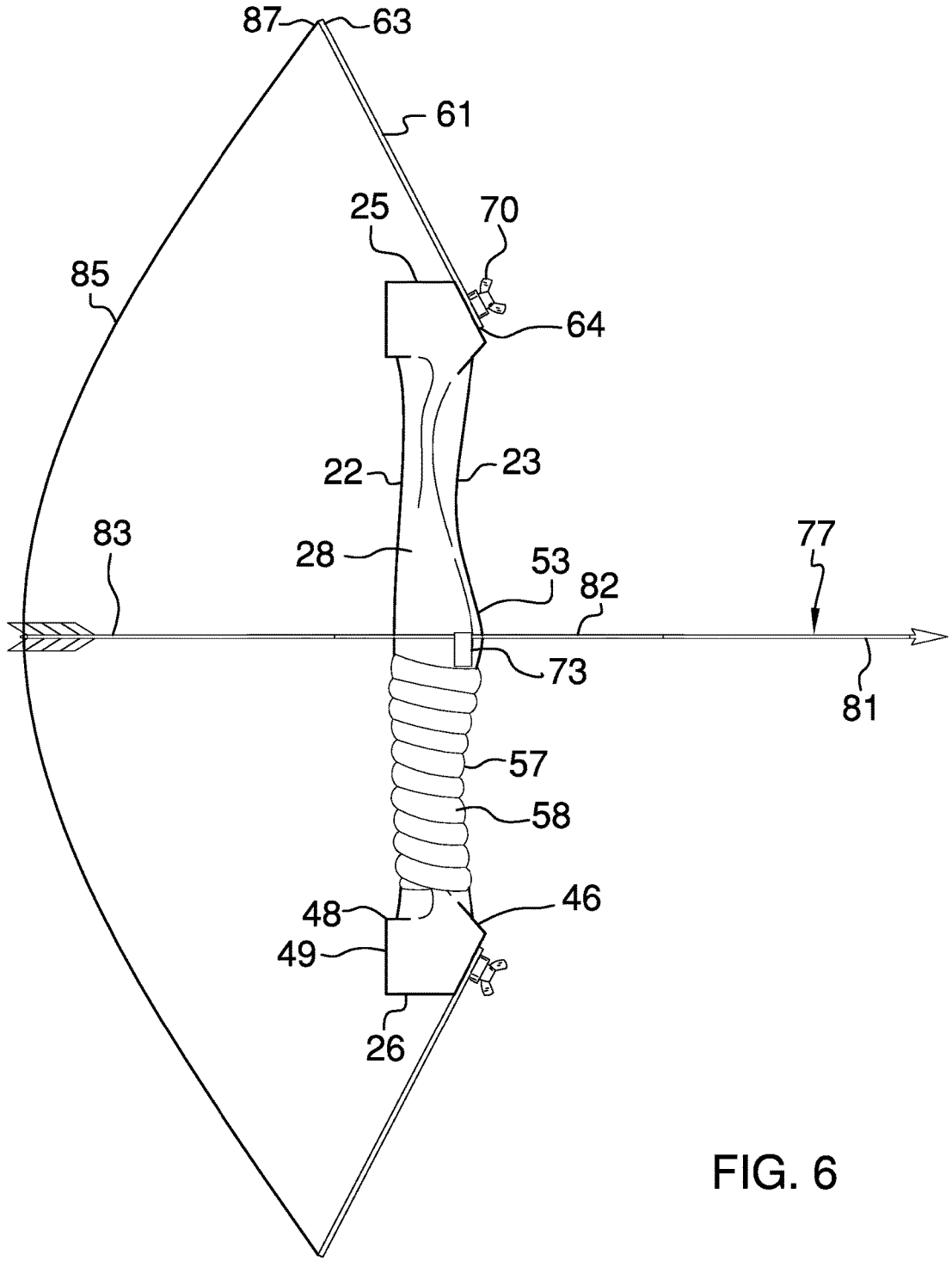
FIG. 6 is an in-use side view.

With reference now to the drawings, and in particular FIGS. 1 through 6 thereof, an example of the instant modular survival tool employing the principles and concepts of the present modular survival tool and generally designated by the reference number 10 will be described.

Referring to FIGS. 1 through 6 the present modular survival tool 10 useful for survival and for military engagement is illustrated. The modular survival tool 10 includes a tool body 20 having a front side 22, a rear side 23, a top end 25; a bottom end 26, a right side 28, and a left side 29. A hollow longitudinal shaft 31 is continuously disposed therein. A threaded first end 33 of the longitudinal shaft 31 is disposed at the top end 25. A second end 34 of the shaft is disposed opposite the first end 33 at the bottom end 26. The second end 34 is selectively closable by a removable cap 36. A storage compartment 38 is continuously disposed within the longitudinal shaft 31 from the second end 34 to proximal the threaded first end 33. A tomahawk axe head 40 is threadably engageable within the threaded first end 33. The axe head 40 includes a cutting portion 42 directed outwardly away from the front side 22, and a pointed-tip blade portion 44 of the axe head 40 directed outwardly away from the rear side 23.

A rearward protrusion 46 is disposed on the rear side 23 proximal each of the top end 25 and the bottom end 26. Each rearward protrusion 46 is directed toward each other and is disposed at a decreasing angle of approximately 15 degrees from the respective top end 25 and bottom end 26. A forward protrusion 48 is disposed on the front side 22 diametrically opposite each rearward protrusion 46. Each forward protrusion 48 has an outer edge 49 parallel to a longitudinal midline axis of the shaft. An outer side 51 of the tool body 20 has a convex midsection 53 on the rear side 23 midway between the rearward protrusions 46. A foramen 55 is disposed in the midsection on each of the right side 28 and the left side 29.

A handle portion 57 is disposed between the rearward protrusion 46 on the bottom end 26 and the midsection 53 of the outer side 51. The handle portion 57 has a cord wrapping 58 disposed along entire length thereof. An aperture 59 is centrally disposed within each of the rearward protrusions 46 and within each of the forward protrusions 48.

A pair of removable limb members 61 is selectively disposed on one of the forward protrusions 48 on the front side 22 and the rearward protrusions 46 on the rear side 23. Each limb member 61 has an upper end 63, a lower end 64, a length 65 between the upper end 63 and the lower end 64, and a hole 67 disposed proximal each of the upper end 63 and the lower end 64. The upper end 63 has a width greater than a width of the lower end 64. A socket cap ball 70 is removably engaged to each hole 67 and a respective one of the apertures 59 of each of the forward protrusions 48 and alternately each of the rearward protrusions 46. The engagement of the socket cap ball 70 to each hole 67 and the respective one of the apertures 59 in the respective forward protrusion 48 is configured to attach the limb members to the front side 22 of the tool body 20 in a position parallel to each other and to the front side 22 from proximal the bottom end 26 to proximal the top end 25. The engagement of the socket cap ball 70 to the hole 67 disposed in the lower end of the respective one of the limb members 61 and the aperture 59 in the respective one of the rearward protrusions 46 is configured to attach one of the limb members 71 to a respective one of the rearward protrusions 46 with the upper end 63 of the respective limb member 61 being disposed outwardly away from the respective top end 25 and bottom end 26.

A substantially conical arrow rest member 73 is removably disposed on at least one of the right side 28 and the left side 29 of the tool body 20. Each arrow rest member 73 has a concave upper side 73 and a threaded connection shaft 75. The connection shaft 75 threadingly engages one of the respective foramens 55. A modular arrow 77 has a plurality of connectable components 79. The connectable components 79 include an arrowhead portion 81, an arrow shaft 82, and a fletching portion 83. A bow string 85 having a pair of external ends 87 is provided. Each external end 87 is engageable to the upper end 83 of a respective one of the limb members 61. The connectable components 79 of the arrow 77 and the bow string 85 are configured to be stored within the storage compartment 38 when the connectable components 79 and the bow string 85 are in an unassembled condition.

A fire starting surface 90 is disposed on an exterior side 92 of the cap 36. The fire starting surface 90 can be formed of steel, including high carbon steel, or ferrocerium.

What is claimed is:

1. A modular survival tool comprising:

a tool body having a front side, a rear side, a top end; a bottom end, a right side, a left side, a hollow longitudinal shaft continuously disposed therein, a threaded first end of the shaft disposed at the top end, a second end of the shaft opposite the first end at the bottom end, the second end being selectively closable by a removable cap, a storage compartment continuously disposed within the shaft from the second end to proximal the threaded first end;

a tomahawk axe head threadably engageable within the threaded first end, a cutting portion of the axe head directed outwardly away from the front side, and a pointed-tip blade portion of the axe head directed outwardly away from the rear side;

a rearward protrusion disposed on the rear side proximal each of the top end and the bottom end, each rearward protrusion directed toward each other and disposed at a decreasing angle from the respective top end and bottom end;

a forward protrusion disposed on the front side diametrically opposite each rearward protrusion, each forward protrusion having an outer edge parallel to a longitudinal midline axis of the shaft;

an outer side of the tool body having a convex midsection on the rear side midway between the rearward protrusions;

a foramen disposed in the midsection on each of the right side and the left side;

a handle portion disposed between the rearward protrusion on the bottom end and a midsection of the outer side, the handle portion having a cord wrapping disposed along entire length thereof;

an aperture centrally disposed within each of the rearward protrusions and within each of the forward protrusions;

a pair of removable limb members selectively disposed on one of the forward protrusions on the front side and the rearward protrusions on the rear side, each limb member having an upper end, a lower end, a length between the upper end and the lower end, and a hole disposed proximal each of the upper end and the lower end;

a socket cap ball removably engaged to each hole and a respective one of the apertures of each of the forward protrusions and alternately each of the rearward protrusions, wherein the engagement of the socket cap ball to each hole and the respective one of the apertures in the respective forward protrusions is configured to attach the limb members to the front side of the tool body in a position parallel to each other and to the front side from proximal the bottom end to proximal the top end, wherein the engagement of the socket cap ball to the hole disposed in the lower end of the respective one of the limb members and the aperture in the respective one of the rearward protrusions is configured to attach one of the limb members to a respective one of the rearward protrusions with the upper end of the respective limb member being disposed outwardly away from the respective top end and bottom end;

a substantially conical arrow rest member removably disposed on at least one of the right side and the left side of the tool body, each arrow rest member having a concave upper side and a threaded connection shaft, the connection shaft threadingly engageable to one of the respective foramens;

a modular arrow having a plurality of connectable components, the connectable components comprising an arrowhead portion, an arrow shaft, and a fletching portion;

a bow string having a pair of external ends, each external end being engageable to the upper end of a respective one of the limb members, the connectable components of the arrow and the bow string configured to be stored within the storage compartment when the connectable components and the bow string are in an unassembled condition.

2. The modular survival tool of claim 1 comprising:

a fire starting surface disposed on an exterior side of the cap.

3. The modular survival tool of claim 1 wherein the upper end of each of the limb members has a width greater than a width of the lower end.

* * * * *